US007819286B2

(12) United States Patent
Antheil et al.

(10) Patent No.: US 7,819,286 B2
(45) Date of Patent: Oct. 26, 2010

(54) BEER KEG AND METHOD OF ASSEMBLY

(75) Inventors: William L. Antheil, Doylestown, PA (US); Nelson Bolton, Trumbauersville, PA (US)

(73) Assignee: Kegx LLC, Doylestown, PA (US)

( * ) Notice: Subject to any disclaimer, the term of this patent is extended or adjusted under 35 U.S.C. 154(b) by 0 days.

(21) Appl. No.: 12/375,120

(22) PCT Filed: Jul. 24, 2007

(86) PCT No.: PCT/US2007/016662

§ 371 (c)(1),
(2), (4) Date: Aug. 31, 2009

(87) PCT Pub. No.: WO2008/013819

PCT Pub. Date: Jan. 31, 2008

(65) Prior Publication Data

US 2010/0018994 A1 Jan. 28, 2010

Related U.S. Application Data

(60) Provisional application No. 60/820,274, filed on Jul. 25, 2006.

(51) Int. Cl.
*B65D 35/56* (2006.01)

(52) U.S. Cl. ..... 222/105; 220/495.01

(58) Field of Classification Search ..... 222/105, 222/100, 106, 107, 632, 635, 209, 394, 397, 222/214; 220/592.19, 592.29, 592.27, 495.1, 220/495.01–495.04, 795, 304, 310.1, 803–806, 220/630, 23.6, 23.87, 480, 481, 632–636
See application file for complete search history.

(56) References Cited

U.S. PATENT DOCUMENTS

| | | | | |
|---|---|---|---|---|
| 2,090,403 | A | 8/1937 | Murray et al. | |
| 2,564,163 | A * | 8/1951 | Leperre | 141/2 |
| 2,787,397 | A | 4/1957 | Radford | |
| 3,219,240 | A | 11/1965 | Campbell, Jr. | |
| 3,294,289 | A | 12/1966 | Bayne et al. | |
| 3,419,173 | A | 12/1968 | Verlinden | |
| 3,696,969 | A | 10/1972 | De Van et al. | |
| 3,827,595 | A | 8/1974 | Reynolds | |

(Continued)

FOREIGN PATENT DOCUMENTS

| | | | |
|---|---|---|---|
| DE | 10306567 | A1 | 8/2004 |

(Continued)

*Primary Examiner*—Lien T Ngo
(74) *Attorney, Agent, or Firm*—Howson & Howson LLP

(57) ABSTRACT

A container, or keg, for storing, shipping, and dispensing a bulk quantity of a fluid, for example, beer or like malt beverage, is provided. The container/keg includes a flaccid bag (56) for containing the fluid and a substantially rigid, pressure-tight, plastic vessel (10) within which the bag (56) is contained. The bag (56) has a mouth (58) secured with a locking ring or the like to an opening in the vessel (10) via which the mouth (58) is accessible externally of the vessel (10) for purposes of filling the bag (56) with the fluid and/or dispensing the fluid from the bag (56). Preferably, the shape of the vessel (10) permits it to be efficiently stacked and shipped when in a full or empty condition. Methods for assembling, filling and shipping kegs are also provided.

19 Claims, 6 Drawing Sheets

U.S. PATENT DOCUMENTS 3,923,186 A 12/1975 Flanders
3,952,904 A 4/1976 Verlinden
3,981,409 A 9/1976 Flanders
4,094,445 A 6/1978 Bevan
4,347,947 A 9/1982 Hammes
4,491,247 A 1/1985 Nitchman et al.
4,531,656 A 7/1985 Nitchman et al.
4,623,075 A 11/1986 Riley
4,690,299 A * 9/1987 Cannon ..... 220/592.19
4,708,938 A 11/1987 Hickinbotham
4,771,917 A 9/1988 Heaps, Jr. et al.
4,867,348 A 9/1989 Dorfman
4,921,135 A 5/1990 Pleet
5,029,734 A 7/1991 Nichols
5,044,514 A 9/1991 Portat et al.
5,069,359 A 12/1991 Liebel
5,074,428 A 12/1991 Wildfeuer
5,115,943 A 5/1992 Coleman
5,129,534 A 7/1992 Dunn
5,193,715 A 3/1993 Schultz
5,199,570 A 4/1993 McKenzie
5,217,142 A 6/1993 Schultz
5,267,669 A 12/1993 Dixon et al.
5,375,741 A * 12/1994 Harris ..... 222/105
5,385,233 A * 1/1995 McKibben et al. ..... 206/386
5,433,346 A 7/1995 Howe
5,480,057 A 1/1996 Papaluca
5,568,876 A 10/1996 Schultz
5,749,489 A 5/1998 Benner et al.
5,897,016 A 4/1999 Wheaton
5,984,132 A 11/1999 Dinouard
6,036,046 A 3/2000 Brambach
6,170,715 B1 1/2001 Evans
6,230,892 B1 5/2001 Przytulla et al.
6,325,212 B2 12/2001 Przytulla et al.
6,354,473 B1 3/2002 Brambach et al.
6,415,943 B1 7/2002 Brambach
6,666,358 B1 12/2003 Field
6,820,775 B2 11/2004 Meike et al.
6,854,246 B2 2/2005 Savage et al.
7,316,329 B2 * 1/2008 Wertenberger ..... 222/105
2006/0138177 A1 6/2006 Wauters et al.
2006/0144870 A1 7/2006 Andersoon
2006/0150637 A1 7/2006 Wauters et al.
2006/0151528 A1 7/2006 Wauters et al.
2006/0163292 A1 7/2006 Wauters et al.
2006/0186136 A1 8/2006 Wauters et al.
2006/0243752 A1 11/2006 Pakkert et al.
2006/0283879 A1 12/2006 Rasmussen
2007/0284371 A1 12/2007 Anderson et al.
2008/0011638 A1 1/2008 Anderson et al.
2008/0110900 A1 5/2008 Veenendaal
2008/0110928 A1 5/2008 Veenendaal

FOREIGN PATENT DOCUMENTS

EP 1736421 A1 12/2006
WO 2008/000574 A1 1/2008

* cited by examiner

FIG.1
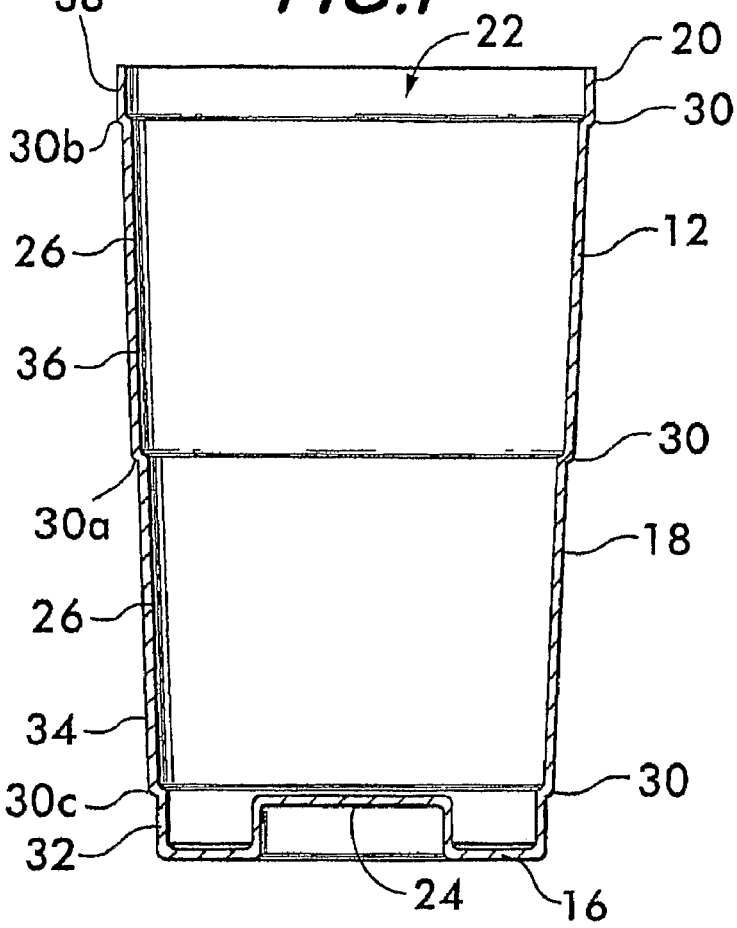
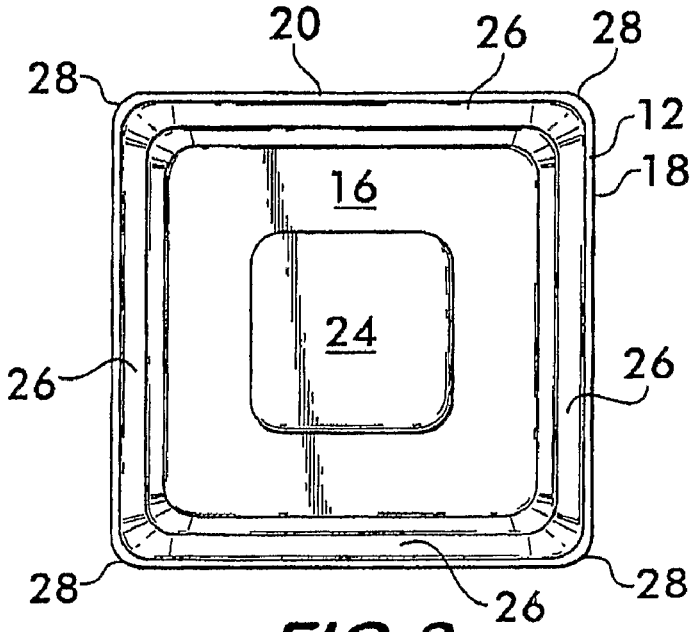
FIG.2

FIG. 3
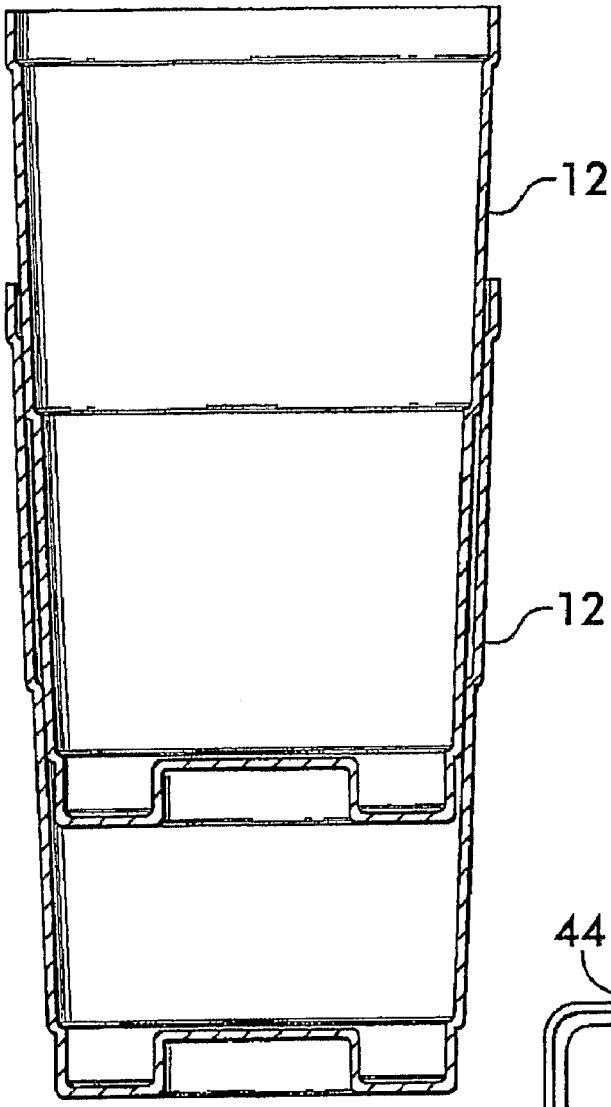
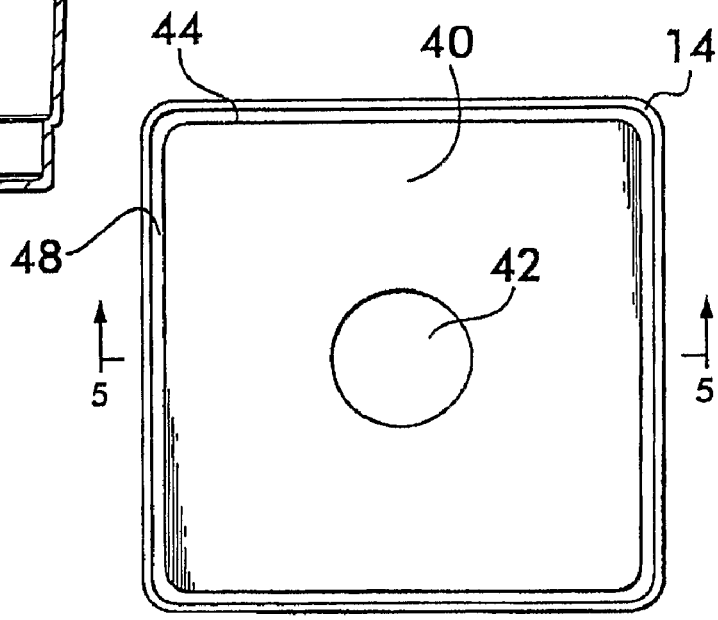
FIG. 4

FIG. 5
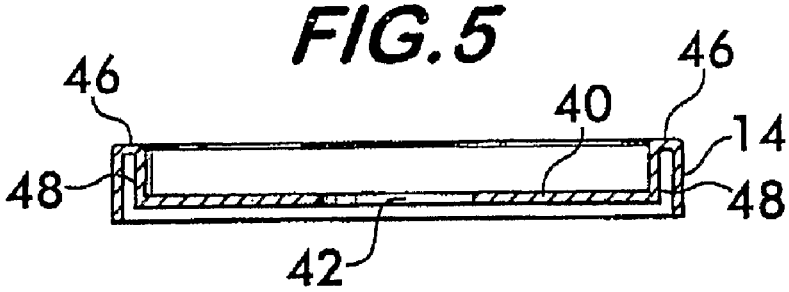
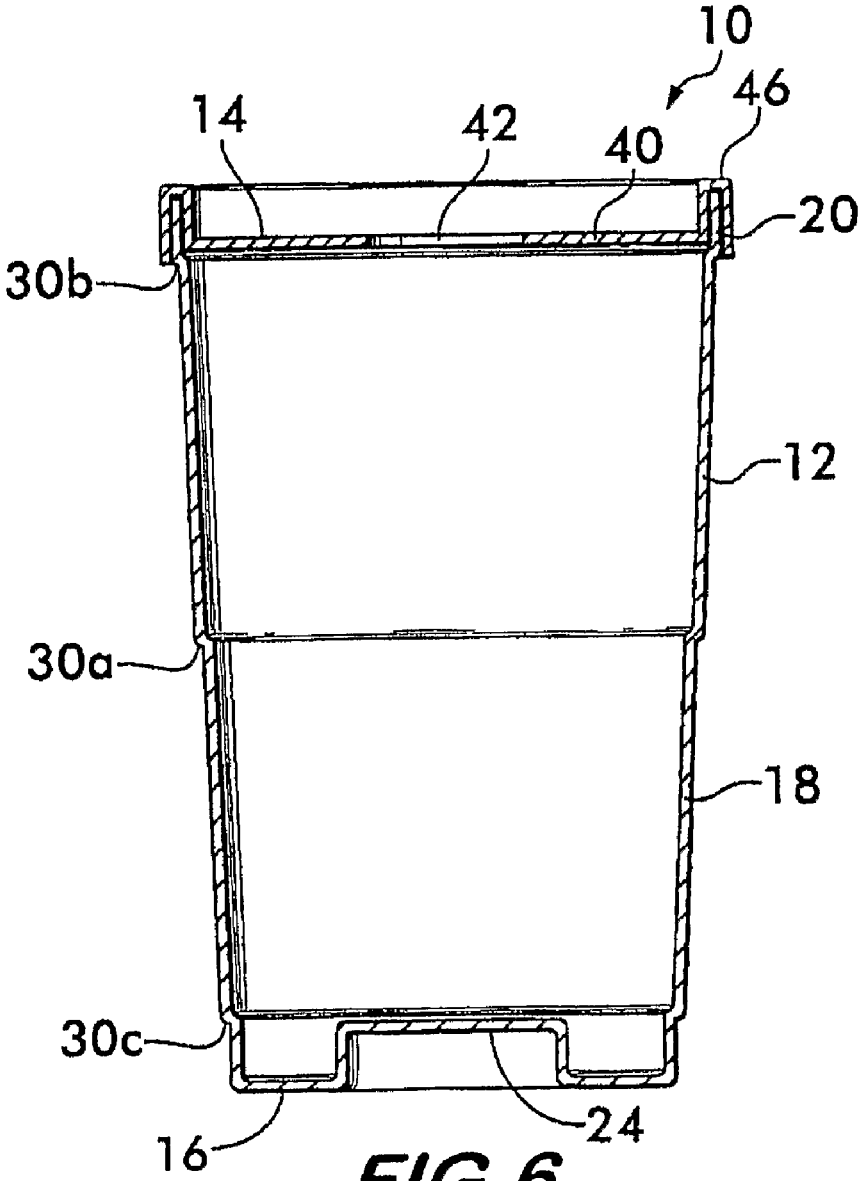
FIG. 6

FIG. 7
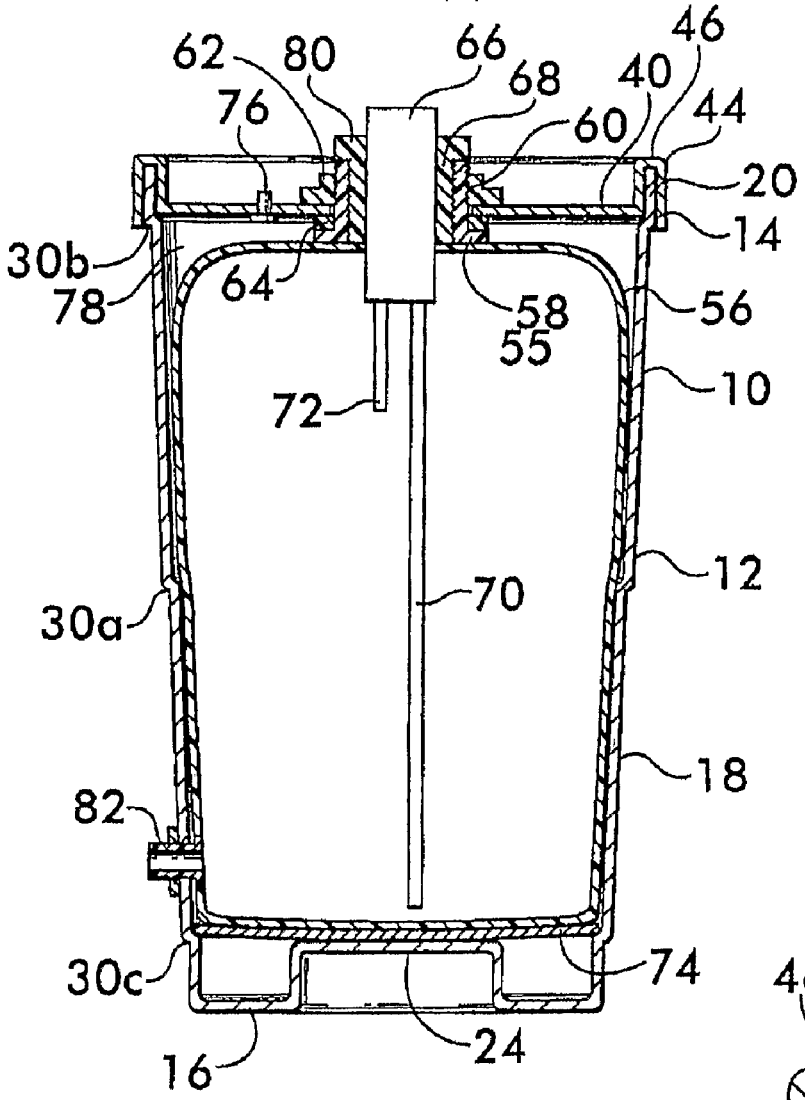
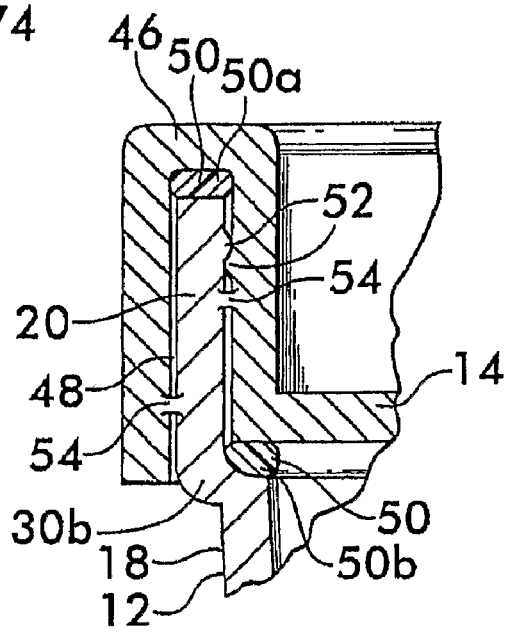
FIG. 8

FIG. 9
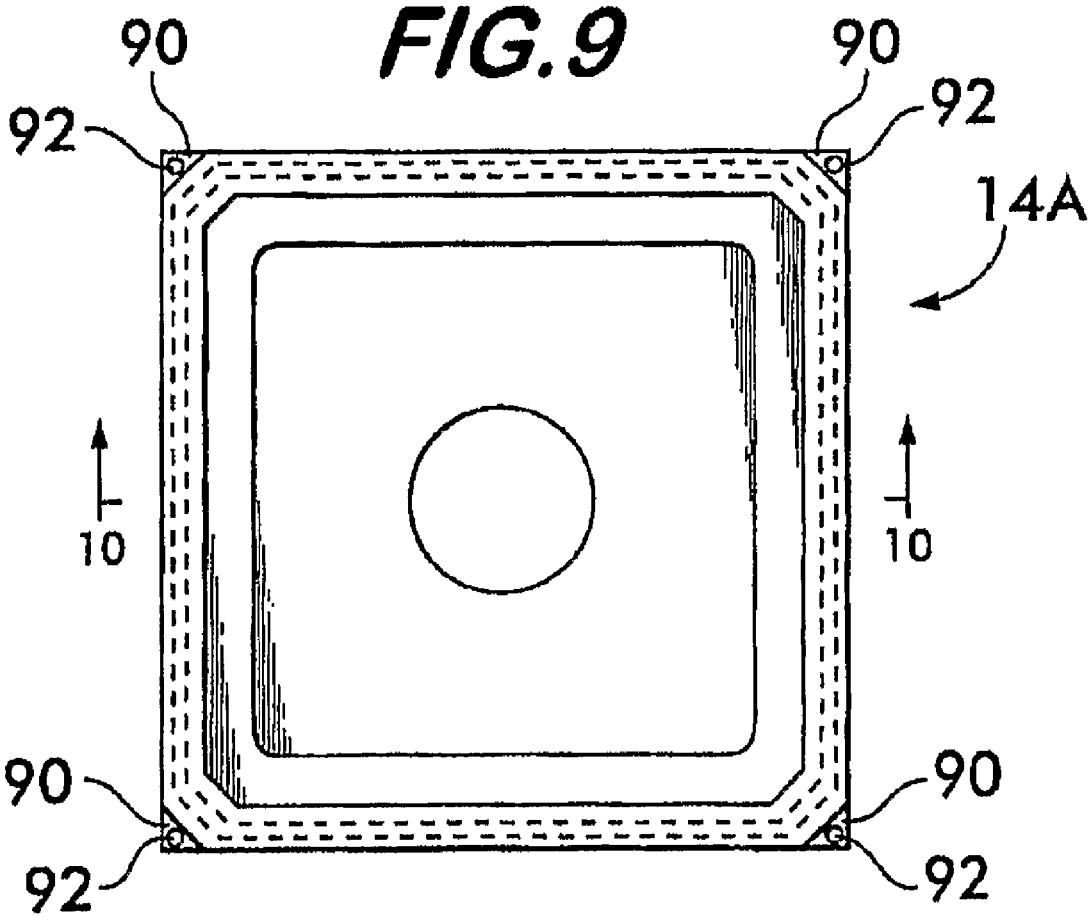
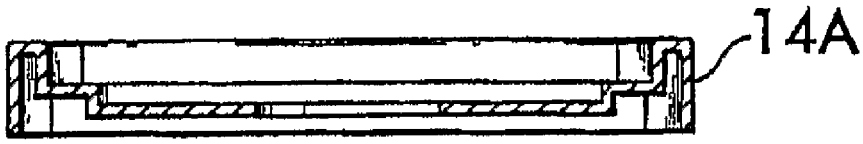
FIG. 10

FIG. 11
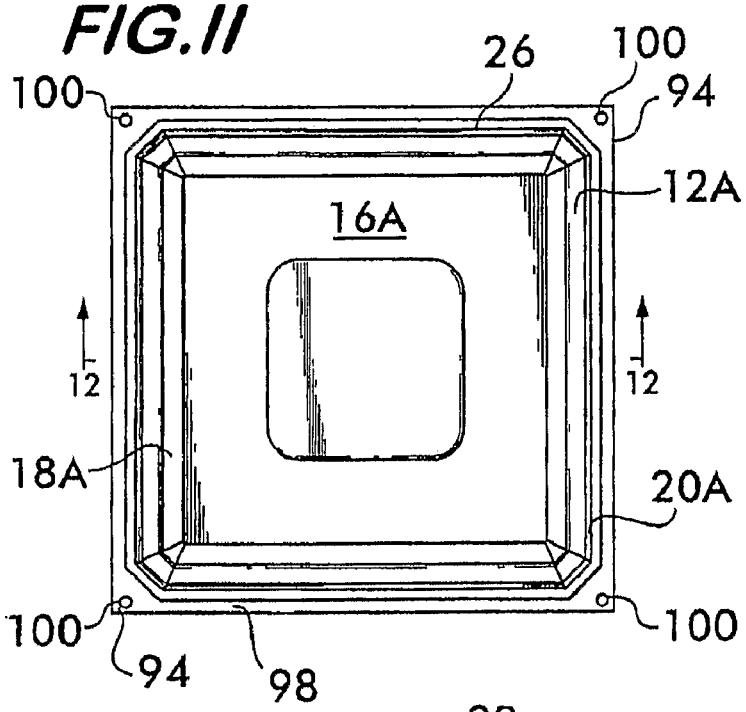
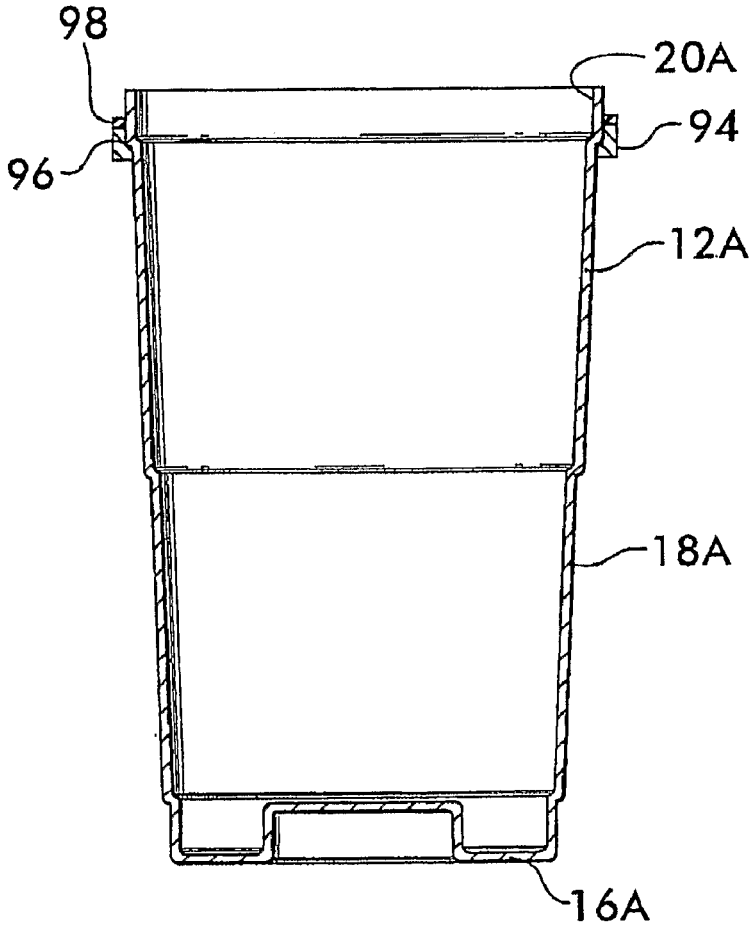
FIG. 12

BEER KEG AND METHOD OF ASSEMBLY

BACKGROUND OF THE INVENTION

The present invention relates to a bulk container for storing, shipping, and dispensing fluids, such as malt beverages. More particularly, the present invention relates to a beer keg and to methods of assembling, filling, disassembling, returning, reusing, and/or recycling beer kegs and like bulk containers.

Conventional beer kegs are of sturdy welded stainless steel construction. As an example, the standard keg used by most North American breweries is a so-called half barrel, also known as a full size keg, and holds about 15.5 gallons (58.7 liters) of beer. So-called quarter barrels, or quarter kegs, are also commonly used and hold about 7.5 gallons (28.4 liters) of beer. These stainless steel kegs are expensive to manufacture, and significant costs are incurred in connection with returning empty kegs for reuse due to their relatively heavy weight and bulk size. Significant expenses are also incurred with respect to cleaning and sterilizing the returned kegs. Further, shipping costs are particularly expensive in connection with kegs requiring round-trip intercontinental shipment, which typically involves transportation of the kegs in standard forty-foot ocean containers.

In an attempt to overcome at least some of the above referenced drawbacks, kegs and like containers have been manufactured using alternate materials and construction. For example, U.S. Pat. Nos. 3,827,595 issued to Reynolds; 3,952,904 issued to Verlinden; 5,897,016 issued to Wheaton; 6,666,358 B1 issued to Field; 5,129,534 issued to Dunn; 5,984,132 issued to Dinouard; and 4,531,656 and 4,491,247 issued to Nitchman et al. disclose beer kegs made of rigid plastic and/or composite materials. So-called "bag-in-a-box" containers for beer are disclosed by DE 10306567 A1 of Klaus and U.S. Pat. Nos. 4,623,075 issued to Riley and 4,690,299 issued to Cannon. U.S. Pat. Nos. 3,219,240 issued to Campbell, Jr.; 4,771,917 issued to Heaps, Jr. et al.; 5,749,489 issued to Benner et al.; and 5,069,359 disclose bag-in-a-box containers for use with other liquids and pastes. In addition, U.S. Pat. Nos. 4,921,135 issued to Pleet; 6,170,715 B1 issued to Evans; and 5,433,346 issued to Howe disclose containers particularly adapted to dispense beverages.

Although the kegs and like containers disclosed in the above referenced patents may function satisfactorily for their intended purposes, there remains a need for a container, or keg, that can be used to contain beer or like fluid and that is inexpensive to manufacture, assemble, and ship. If reuse and/or recycling of the container/keg are contemplated, the container/keg should be able to be configured in a knockdown configuration capable of being returned in a compact condition. In addition, the container/keg should be of a construction that prevents loss of quality of the contained fluid or malt beverage in the event the fluid or beverage is stored therein for extended periods of time, such as typically required in intercontinental shipment.

BRIEF SUMMARY OF THE INVENTION

More specifically, the present invention is a container, or keg, for storing, shipping, and dispensing a bulk quantity of a fluid, for example, beer or like malt beverage. The container/keg includes a flaccid bag for containing the fluid and a substantially rigid pressure-tight vessel within which the bag is contained. The bag has a mouth secured with a locking ring or the like to an opening in the vessel via which the mouth is accessible externally of the vessel for purposes of filling the bag with the fluid and/or dispensing the fluid from the bag. In an alternate embodiment, the flaccid bag can be replaced with a substantially rigid layer of a metallic coating applied on the interior walls of the vessel.

In some contemplated embodiments of the present invention, the vessel includes a tub having a closed end defining a base for supporting the tub in a normal upright position and a sidewall projecting from the base to a rim defining an open top. The sidewall of the tub is tapered upwardly and outwardly such that a periphery of the rim is greater than a periphery of the base. A separate lid is engagable with the rim to form a fluid-tight connection therewith. The flaccid bag contains the fluid, such as beer, and is located within the tub beneath the lid.

In some contemplated embodiments, the tub and lid are vacuum molded or thermoformed from a recyclable thermoplastic material, and the bag includes layers of a metallic material. The space within the tub external and surrounding the bag can be pressurized with a gas, such as ambient air, $CO_2$, or nitrogen to a pressure at or above atmospheric pressure. In addition, preferably, the tubs are capable of being stacked in a nested compact condition for efficient return of empty tubs for reuse or recycling.

According to yet another aspect of the present invention, a method of assembling and/or transporting a keg is provided. A mouth finish of a flaccid membrane bag is secured to an opening in a lid with a locking ring or the like. The bag is positioned within a tub, and the lid is connected to a rim of the tub. Thereafter, the bag is filled with a beverage, such as beer, and a keg valve is installed within the mouth of the finish. Preferably, a fluid-tight seal is created between the lid and the tub to produce a pressure-tight vessel in which the bag is housed. This lengthens the shelf-life of the beer beyond the period that would be provided solely by the bag. Preferably, the tub and lid are made from plastic by vacuum forming techniques, the lid is snap-fit, fused, welded, and/or mechanically fastened to the rim of the tub, and one or more gaskets are utilized to ensure the formation of fluid-tight seals. Further, the kegs can be shipped in a stacked condition, and empty tubs can be nested and returned for reuse or recycling.

BRIEF DESCRIPTION OF THE DRAWINGS

The features and advantages of the present invention should become apparent from the following description when taken in conjunction with the accompanying drawings, in which:

FIG. 1 is a cross-sectional view of a tub section of an outer vessel according to the present invention;

FIG. 2 is a plan view of the tub section illustrated in FIG. 1;

FIG. 3 is a cross-sectional view showing a pair of tub sections in a nested compact condition;

FIG. 4 is a plan view of a lid of the outer vessel according to the present invention;

FIG. 5 is a cross sectional view of the lid along line 5-5 of FIG. 4;

FIG. 6 is a cross-sectional view showing the lid of FIG. 4, engaged on the tub section of FIG. 1 according to the present invention;

FIG. 7 is a cross-sectional view of an assembled keg according to the present invention;

FIG. 8 is an enlarged cross-sectional view showing the engagement of the lid to the tub section;

FIG. 9 is a plan view of an alternate lid according to the present invention;

FIG. 10 is a cross sectional view of the alternate lid along line 10-10 of FIG. 9;

FIG. 11 is a plan view of an alternate tub section for use with the alternate lid of FIG. 9; and FIG. 12 is a cross-sectional view of the alternate tub section along line 12-12 of FIG. 11.

DETAILED DESCRIPTION OF THE INVENTION

The present invention is directed to a lightweight container for containing a bulk quantity of a liquid, such as a malt beverage or beer. Of course, the present invention can be used to contain other liquid beverages and non-beverage products. Preferably, the container permits efficient stacking when shipped full and when returned in an empty condition. In addition, preferably the containers can be reused and/or recycled. As an example, the container can be a beer keg for containing about 20 liters (5.3 gallons) of beer. Such a container may weigh about 50 lbs when full, with the beer weighing 45 lbs and the keg of the present invention weighing only about 5 lbs or less. Of course, the container/keg of the present invention can be made in different sizes providing any desired capacity.

FIGS. 1-6 disclose an example of an outer rigid vessel 10 of a first embodiment of a container/keg according to the present invention. The vessel 10 does not directly contact the fluid contained therein; rather, it merely supports an inner vessel, such as a flaccid bag or the like (see FIG. 7), containing the fluid. The vessel 10 is preferably of two piece construction including a tub 12 and a separate lid 14.

The tub 12 has a closed-end, or base, 16 and a sidewall 18 projecting from the base 16 to a rim 20 defining an open-end, or open top, 22. The base 16 has a central recess 24 and is adapted to support the vessel 10 in an upright position on a supporting surface or on a lid of a like vessel in a stacked condition. Preferably, the tub 12 is of one-piece molded construction. For example, the tub 12 can be manufactured by high-temperature vacuum molding a malleable sheet of thermoplastic or thermoformable material. As an example, ABS (Acrylonitrile Butadiene Styrene) plastic can be utilized.

As best illustrated in FIGS. 1, 3 and 6, the sidewall 18, or at least portions thereof, tapers outward in a direction from the base 16 to the rim 20. Due to the taper of the sidewall 18, the outer periphery, or footprint, of the rim 20 is larger than that of the base 16. This provides advantages with respect to the manufacture, shipping, and return of the vessel 10. For example, during manufacture, the taper enables ready removal from a mold; during shipping, the taper ensures that a supply of refrigerated air can surround each vessel 10; and during return shipment, the taper enables efficient nesting of empty tubs 12 as shown in FIG. 3 so that more vessels 10 can be returned in a reduced amount of space. The base 16 being smaller than the rim 20 also ensures that the base 16 can be stacked and received on a lid of a like keg/container. The central recess 24 of the base 16 ensures that any fitment secured on the lid of an underlying keg/container can be accommodated therein. For example, the central recess 24 can extend to a height of about 1.5 inch or more to accommodate the fitment.

As best illustrated in FIG. 2, the tub 12 can have a substantially square footprint, or outer periphery. Thus, the sidewall 18 includes an alternating array of substantially planar panel sections 26 and corner post structures 28. As alternatives, the tub 12 can have a rectangular, hexagonal, octagonal, or other multi-sided configuration, or can be circular or oval in transverse cross-section. Square, or octagonal configurations are preferred because this enables efficient side-by-side stacking of the vessels 10 and enables a maximum number of kegs/containers to be loaded, for instance, in forty-foot ocean shipping containers.

One or more peripherally-extending ledges, offsets, or step structures, 30 can be formed or molded in the sidewall 18 for various purposes. In the illustrated embodiment, the outwardly-directed ledges 30 define separate tiers, 32, 34, 36, and 38, of the sidewall 18. For example, the tier 32 corresponds to the base 16, tiers 34 and 36 are intermediate tiers, and tier 38 corresponds to the rim 20. The ledge 30*a* extending between the intermediate tiers 34 and 36 provides a reinforcement function preventing the generally planar sidewall panels 26 from bulging outward. Thus, a sturdy tub structure can be formed with a minimum of plastic. The ledge 30*b* beneath the rim 20 can be used to support a gasket for forming a fluid-tight connection with the lid 14 (see FIG. 8). Finally, the ledge 30*c* adjacent the base 16 can be used to support a concave false bottom insert (see FIG. 7) that directs the liquid in the bag to a central low point area.

The lid 14 is best illustrated in FIGS. 4 and 5 and has a generally planar top 40 with a centrally disposed aperture, or opening, 42. The opening 42 is used to connect a mouth of an inner vessel to the lid 14 (see FIG. 7). A reversely-turned outermost edge section 44 of the lid 14 projects upwardly from the top 40 and defines a peripheral ridge 46 and a closed-ended channel 48 (see FIG. 5). The channel 48 is adapted to receive and engage the rim 20 of the tub 12 so that the lid 14 can close and seal the open end 22 of the tub 12 (see FIGS. 6 and 8). The upstanding ridge 46 permits a base 16 of a like vessel 10 to be seated therein on the top 40 of the lid 14. Preferably, the lid 14 is formed of a thermoplastic material, such as ABS plastic, and is made using high-temperature vacuum molding or like techniques.

If the liquid contained by the inner vessel of the present invention has a relatively-short shelf life, then the tub 12 and lid 14 can be used to form a pressure-tight outer vessel 10. For example, beer in multi-membrane bags having metallic layers will typically become flat and/or lose its desired quality within about 6 to 8 weeks after filling and sealing. This relatively short period of time is typically insufficient for intercontinental shipment. Thus, to extend this period, the tub 12 and lid 14 of the present invention are mated together such that a fluid-tight connection is formed therebetween.

An example of a fluid-tight connection between the lid 14 and rim 20 of the tub 12 is illustrated in FIG. 8. One or more elastomeric gaskets 50 are sandwiched in a compressed condition between the lid 14 and rim 20 to create the seal. For instance, a first gasket 50*a* can be supported on top of the rim 20 and a second gasket 50*b* can be supported on the ledge 30 directly beneath the rim 20. The lid 14 is pressed downwardly on the rim 20 and is secured thereto. For example, a snap-fit connection provided by a pair of cooperating ribs 52 can be used to secure the lid 14 to the rim 20 in a position in which the gaskets 50 are compressed. Thereafter, the lid 14 can be spot-welded to the tub 12 as shown by welds 54 in FIG. 8. As an alternative, a gasket made of a plastic having a lower melting temperature than that of the lid and tub can be utilized. Such a gasket can be melted such as by flowing current through a wire extending within the gasket and can be permitted to solidify to fuse the lid 14 to the rim 20. The use of an external hasp, clip, clasps, clamps, straps, or other mechanical fasteners can also be used to ensure that the lid 14 remains tightly sealed to the rim 20. As an example, see the alternate embodiment illustrated in FIGS. 9-12.

As illustrated in FIG. 7, preferably the inner vessel of the keg/container of the present invention is a flaccid multi-membrane bag 56. For example, such a bag may be formed of multiple plastic and/or metallic layers that inhibit the flow of gas through the walls of the bag to very low levels. As an alternative, a plastic blow-molded bag or the like could also be utilized. According to the present invention, the flow of gas through the walls of the bag can be further reduced by containing the bag in the pressure-tight vessel 10 thereby providing pressure equilibrium.

The bag 56 has at least one substantially rigid mouth finish 58 made of plastic or the like that is securable to the opening 42 in the lid 14 and/or to other openings in the lid or tub, as desired. Preferably, the outer surface 60 of the mouth finish 58 is threaded and is secured to the lid 14 via a sealing ring 62 that is screwed or snap-fit to the outer surface 60 of the mouth finish 58 adjacent the exterior of the lid 14 to capture the mouth finish 58 thereto. This connection also includes a gasket 64 that is compressed and forms a fluid-tight connection. As an alternative, a mouth of the bag can be designed to secure to an opening in the sidewall or base of the tub adjacent the bottom of the tub to permit dispensing via the bottom of the tub (see mouth finish 82 adjacent base 16 in FIG. 7).

A fitment 66 is secured within the mouth finish 58 of the bag 56. Preferably, the inner surface 68 of the mouth finish 58 is threaded and the fitment 66, or an adaptor 80 in which the fitment is connected, is secured thereto via threaded engagement. The fitment 66 typically includes concentric valve passages, one connecting to an elongate tube 70 through which beer or the like is filled into the bag 56 or is dispensed from the bag 56, and the other providing a passage 72 for gas. During a dispensing operation, gas under pressure is permitted to enter the bag 56 via passage 72 to thereby force beer to flow out of the bag 56 via the tube 70. Typically, the fitment 66 interconnects to a keg coupler (not shown), and together they form a keg tap. The keg coupler interconnects the fitment 66 with a source of pressurized $CO_2$ or nitrogen and to a beer faucet via tubing or the like. The source of pressurized gas and/or fitment can be triggered by a remote dispensing tap. There are several types of keg taps utilized by breweries, and the mouth finish 58 of the bag 56 can be designed to fit all with or without the use of special adaptor-type connectors.

An insert 74 can be positioned on the base 16 of the tub 12 before the bag 56 is positioned within the tub 12. For example, insert 74 can be made of cardboard, plastic or the like and be supported on ledge 30*c* and the central recess 24 of the base 16. Preferably, the ledge 30*c* is located at an elevation slightly higher than the central recess 24 so that the insert 74 forms a concave false bottom that positions the bottom of the bag 56 centrally within the vessel 10 adjacent the end of the tube 70.

Further, a pressure valve 76, such as a Schrader valve, can be located on the lid 14 or tub 12. The Schrader valve 76 permits communication with a chamber 78 within the outer vessel 10 surrounding the bag 56. For example, during filling of the bag 56, the valve 76 can be positioned in an open-condition to allow air to escape the outer vessel 10 while the bag 56 expands therein. Thereafter the valve 76 can be closed or used to pressurize the chamber 78 to a pressure at or above atmospheric pressure. The valve 78 can also be used to remove ambient air from the chamber 78 and replace it with $CO_2$ or nitrogen. Still further, the valve 76 cam be used during a dispensing operation by filling the chamber 78 with a gas to force the beer in the bag 56 to flow through the dispensing tube 70. In this way, gas is not required to be charged into the bag 56 thereby permitting the beer to remain fresher for an extended period of time.

Finally, as an alternative to using a flaccid bag 56, the interior surfaces of the plastic tub 12 and lid 14 of the present invention can be lined with a layer of glass or a layer of a metal, such as a thin layer of aluminum. Thus, the thin layer of aluminum or glass would form the inner vessel and would contain the beer or like fluid.

FIGS. 9-12 illustrate an alternate embodiment of an outer vessel including a lid 14A that can be mechanically fastened to a tub 12A. The tub 12A and lid 14A are substantially square in transverse cross-section, except that each corner is truncated. The lid 14A includes flanges 90 at each truncated corner, and each flange 90 includes an aperture 92 or the like for receiving a separate fastener (not shown). A separately molded plastic girdle, collar or the like 94 is inserted around the sidewall 18A of the tub 12A from the base 16A of the tub 12A until it engages under the lip 96 of the rim 20A of the tub 12A as illustrated in FIG. 12. A gasket 98 can be mounted on the top of the collar 94. The collar 94 and gasket 98 define apertures 100 that register with apertures 92 when the lid 14A is applied to the tub 12A. Thereafter, separate fasteners, such as bolts, clips, or the like are applied through the apertures 92 and 100 to mechanically secure the lid 14A to the tub 12A. The gasket 98 ensures a fluid tight seal between the free edge of the lid 14A and the underlying collar 94 and tub 12A.

Turning to the method of the present invention, a procedure for assembling, filling and transporting containers, such as beer kegs, is provided. A mouth finish of a flaccid multi-membrane bag is sealed to an opening in a lid with a sealing ring or the like. Preferably, this connection is a fluid-tight connection. Thereafter, a lid is mounted onto a tub such that the bag is sealed within an outer vessel formed by the tub and lid. The connection of the lid to the tub is also a fluid-tight connection and permits the lid and tub to form a pressure-tight vessel. The bag is filled with a beverage, such as beer, and the mouth finish of the bag is provided with a fitment, such as a beer keg valve, to seal the beer in the bag.

When the lid is mounted on the tub, preferably the lid is mechanically fastened, snap-fit, fused, or welded to the rim of the tub such that one or more gaskets form a fluid-tight connection therebetween. In addition, when the bag is filled with beer, ambient air located within the sealed vessel external of the bag is permitted to freely escape the vessel via a pressure valve positioned in an open condition. Thus, as the bag expands, air within the vessel is removed. After filling the bag, the pressure valve is closed and/or is used to pressure the vessel with a gas, such as ambient air, $CO_2$, or nitrogen, to a pressure at or above ambient atmosphere. This ensures that the beer will remain fresh and at peak quality for extended periods of time permitting transcontinental shipment.

Preferably, the keg is filled utilizing automated filling equipment. The keg is located in a specially-designed caddy so that standard filling equipment can be used without requiring any modifications thereto. Alternatively, the base of the keg can be designed such that it can be used with standard filling equipment without a caddy. After the bag is filled with beer and a fitment is secured to the mouth finish of the bag, the keg is shrink-wrapped. The shrink-wrapping can contain indicia concerning the type of beer, intended destination, date of filling, advertisements, bar codes, or like information. In addition, shrink-wrapping permits quick identification of leaking kegs since the beer will be present and visible behind the shrink wrap. A dispensing fitting, such as a keg coupler, can be attached to the keg valve and the kegs can be stacked on top and adjacent each other on a pallet before placement within a shipping container, such as a forty foot ocean shipping container.

The tubs and lids can be manufactured from ABS plastic or other thermoplastic materials utilizing vacuum forming, blow molding, thermoforming or like techniques. Preferably, the tubs have a square, rectangular, octagonal, or other multi-sided footprint and/or horizontal cross-section with or without truncated corner sections. In addition, preferably the tubs taper outwardly from base-to-rim. Such a tub and lid combination is inexpensive to manufacture, is lightweight, and can be efficiently stacked in a tight shipping formation. If shipped in a refrigerated container, the tapered walls ensure a path for refrigerated air to flow around each tub.

After use, the bags can be discarded and the fitments, such as keg valves/couplers can be returned or reused. In addition, the lightweight plastic tub and lids can be separated and returned for reuse or for recycling. Empty tubs can be stacked in a nested compact condition when returned to reduce shipping costs. Upon return, the tubs and lids can be readily cleaned and sterilized for reuse, on can be recycled.

While a preferred containers/kegs and methods have been described in detail, various modifications, alterations, and changes may be made without departing from the spirit and scope of the containers/kegs and methods according to the present invention as defined in the appended claims.

The invention claimed is:

1. A knockdown container for storing, shipping, and dispensing a bulk quantity of a fluid subject to loss of quality, comprising:

a flaccid multi-membrane bag (56) for containing the fluid and for inhibiting the flow of gas therethrough, said bag (56) having a rigid mouth finish (58) to which a dispensing fitment (66) is secured through which the fluid is filled or dispensed;

a substantially rigid pressure-tight plastic vessel (10) within which said bag (56) is contained, said vessel (10) having an opening (22) to which said mouth finish (58) is secured and from which said dispensing fitment (66) is accessible externally of said vessel (10), and said vessel (10) including a substantially rigid tub (12, 12A) having a closed end (16, 16A) and a sidewall (18, 18A) extending from said closed end (16, 16A) to a rim (20, 20A) defining an open end and a closure (14, 14A) engagable with said rim (20, 20A) for forming a fluid-tight connection therewith to seal said open end, at least portions of said sidewall (18, 18A) of said tub (12, 12A) tapering outward of said closed end (16, 16A) such that a periphery of said rim (20, 20A) is larger than a periphery of said closed end (16, 16A);

a Schrader valve (76) extending through said vessel (10) and communicating with a space (78) within said pressure-tight vessel (10) external of said bag (56);

at least one elastomeric gasket positioned between said tub and said closure on or adjacent said rim for forming said fluid-tight connection between said tub and said closure; and a fastener for mechanically securing said closure to said tub, said fastener being located on said vessel entirely on an external side of said gasket relative to said fluid-tight connection such that said fastener does not compromise said fluid-tight connection formed by said gasket.

2. A container according to claim 1, wherein said space (78) within said vessel (10) is pressurized above atmospheric pressure with a gas.

3. A container according to claim 1, wherein said sidewall (18, 18A) is multi-sided and includes an array of panel sections (26) interconnected by corner post structures (28) extending from said closed end (16, 16A) to said rim (20, 20A).

4. A container according to claim 1, wherein said container is a keg for a malt beverage, and wherein said dispensing fitment (66) is a concentric valve fitment which forms part of a keg tap for tapping said keg.

5. A knockdown keg for a malt beverage, comprising:

a vessel (10) constructed from a single-piece, molded, plastic tub (12, 12A) and a separate, single-piece, molded plastic closure (14, 14A), said tub having a closed end and a sideway (18, 18A) extending from said closed end to a rim (20, 20A) defining an open end (22), said sidewall (18, 18A) of said tub (12, 12A) being outwardly tapered between said closed end and said open end (22) so that a plurality of like tubs (12, 12A), when empty, are stackable in a compact nested condition, said separate, single-piece, molded plastic closure (14, 14A) being securable to said rim (20, 20A) for closing said open end (22);

a flaccid multi-membrane bag (56) for containing the malt beverage and for inhibiting the flow of gas therethrough, said bag (56) being locatable within said vessel and having a substantially rigid mouth finish (58) securable to an opening (42) in said vessel;

a concentric valve dispensing fitment secured to said mouth finish of said bag, said concentric valve mouth finish forming part of a keg tap for tapping said keg;

a Schrader valve (76) in one of said closure (14, 14A) and tub (12, 12A) for communicating with a space (78) within said vessel (10) external of said bag (56);

at least one elastomeric gasket positioned on or adjacent said rim (20, 20A) for forming a fluid-tight seal between said closure (14, 14A) and said tub (12, 12A) providing said vessel (10) as a pressure-tight vessel within which said bag (56) is housed; and a fastener for mechanically securing said closure to said tub, said fastener being located on said vessel entirely on an external side of said gasket relative to said fluid-tight connection such that said fastener does not compromise said fluid-tight connection formed by said gasket;

whereby the keg is provided with a knockdown configuration capable of being stacked in the compact nested condition and, when assembled, is able to prevent loss of quality to the malt beverage should the malt beverage be stored in the keg for an extended period of time.

6. A keg according to claim 5, wherein said space (78) is pressurized with a gas to a pressure above ambient pressure.

7. A keg according to claim 5, wherein said at least one gasket includes a pair of gaskets (50*a*, 50*b*), one of said gaskets (50*a*) engaging an upper surface of said rim (20) and another of said gaskets (50*b*) engaging a ledge (30*b*) formed by said sidewall (18) below said upper surface of said rim (20).

8. A keg according to claim 5, wherein said closure (14, 14A) is secured to said tub (12, 12A) such that said gasket (50, 50*a*, 50*b*, 98) is in a compressed condition.

9. A keg according to claim 5, wherein outer peripheries of said closed end and rim (20A) are substantially square with truncated corners.

10. A keg according to claim 9, wherein said sidewall (16, 16A) includes a plurality of tiers (32, 34, 36, 38) between said closed end and said rim (20, 20A), each of said tiers (32, 34, 36, 38) tapering upwardly and outwardly, and each adjacent pair of tiers (32, 34, 36, 38) being interconnected via a peripherally-extending ledge (30*a*, 30*b*, 30*c*).

11. A keg according to claim 10, wherein said closed end has a central recess (24) extending to a height of at least about 1.5 inches for accommodating a fitment (66) of a like keg on which said closed end is stacked.

12. A keg for a malt beverage, comprising:

a single-piece, molded, plastic tub having a closed end with a central recess and a sidewall extending from said closed end to a rim defining an open end, said sidewall being tapered between said closed end and said open end so that a plurality of like tubs, when empty, are stackable in a compact nested condition, said sidewall including a plurality of tiers between said closed end and said rim, each of said tiers tapering outwardly and each adjacent pair of tiers being interconnected via a peripherally-extending ledge;

a separate, single-piece, molded plastic closure securable to said rim for closing said open end wherein a connection between said closure and said tub is fluid-tight providing a pressure-tight vessel;

a flaccid multi-membrane bag for containing the malt beverage being located within said vessel and having a substantially rigid mouth securable to an opening in said vessel; and a false bottom insert located within said tub and supported on said closed end, said insert providing a surface on which said bag is supportable, a central portion of said insert is supported on said central recess of said closed end and an outer peripheral edge section of said insert is supported on one of said ledges, said ledge on which said insert is supported extends at a higher elevation within said tub than an elevation of said central recess of said closed end.

13. A keg according to claim 5, further comprising an adaptor (80) that is secured to said mouth finish and interconnects to said dispensing fitment.

14. A keg according to claim 5, further comprising a separately manufactured collar (94) that extends about said tub (12A) and engages said tub (12A) underneath said rim (20A) and that can be mechanically secured to said lid (14A).

15. A knockdown container according to claim 1, wherein said multi-membrane bag is formed of multiple plastic or metallic layers.

16. A knockdown container according to claim 3, wherein outer peripheries of said closed end and rim are substantially square with truncated corners, and wherein said sidewall includes a plurality of tiers between said closed end and said rim, and each adjacent pair of tiers being interconnected via a peripherally-extending ledge.

17. A knockdown container according to claim 4, wherein said fastener is selected from the group consisting of a mechanical fastener, bolt, hasp, clip, clasp, clamp, and strap.

18. A knockdown keg according to claim 5, wherein said fastener is selected from the group consisting of a mechanical fastener, bolt, hasp, clip, clasp, clamp, and strap.

19. A knockdown keg according to claim 5, wherein said multi-membrane bag is formed of multiple plastic or metallic layers.

* * * * *